US007458105B2

(12) United States Patent
Tao

(10) Patent No.: US 7,458,105 B2
(45) Date of Patent: Dec. 2, 2008

(54) CONVERTIBLE AND SWIVELING NECKTIE

(76) Inventor: Richard Tao, 490 Oakwood Ave., Webster Groves, MO (US) 63119

( * ) Notice: Subject to any disclaimer, the term of this patent is extended or adjusted under 35 U.S.C. 154(b) by 0 days.

(21) Appl. No.: 11/200,979

(22) Filed: Aug. 10, 2005

(65) Prior Publication Data

US 2007/0033703 A1 Feb. 15, 2007

(51) Int. Cl.
*A41D 25/00* (2006.01)

(52) U.S. Cl. ..... 2/144

(58) Field of Classification Search ..... 2/144–145, 2/147–149, 152.1, 150, 153
See application file for complete search history.

(56) References Cited

U.S. PATENT DOCUMENTS

| | | | | |
|---|---|---|---|---|
| 2,422,992 | A | 6/1947 | Taborski | 2/153 |
| 2,440,880 | A | 5/1948 | Taborski | 2/150 |
| 3,458,868 | A | 8/1969 | Smith | 2/150 |
| 3,735,420 | A | 5/1973 | New | 2/150 |
| 3,959,825 | A | 6/1976 | Hughes | 2/146 |
| 4,368,544 | A | 1/1983 | Smith | 2/153 |
| 5,084,916 | A | 2/1992 | Austin | 2/149 |
| 5,088,120 | A | 2/1992 | Yen | 2/152 |
| D341,929 | S | 12/1993 | Gaffney | D2/605 |
| 5,575,007 | A | 11/1996 | Gaffney | 2/144 |
| 5,778,453 | A | 7/1998 | Chen | 2/148 |
| 6,205,587 | B1 | 3/2001 | Shiffler | 2/146 |
| 6,687,914 | B2 | 2/2004 | Conyers | 2/144 |
| 6,691,319 | B1 | 2/2004 | Simon | 2/144 |
| 2004/0187187 | A1 | 9/2004 | Morrison-Gale | 2/144 |
| 2005/0064410 | A1 | 3/2005 | Jallard | 2/149 |

FOREIGN PATENT DOCUMENTS

| | | |
|---|---|---|
| EP | 0672358 | 2/1995 |

*Primary Examiner*—Tejash Patel
(74) *Attorney, Agent, or Firm*—Brian B. Diekhoff; Polsinelli Shalton Flanigan Suelthaus PC

(57) ABSTRACT

The present invention relates to a convertible and a swiveling necktie and a method of using the convertible and swiveling necktie. The convertible and swiveling necktie includes a knot body, a tail body, wherein the tail body swivels relative to the knot body, and the tail body is urged to settle at increments at approximately 180 degrees to maintain a desired side of a fabric tail. The present invention further includes the knot body forming an elliptically-shaped receiving portion, the tail body forming an elliptically-shaped member that is received by the elliptically-shaped receiving portion, and wherein the tail body is swively connected to the knot body.

20 Claims, 14 Drawing Sheets

CONVERTIBLE AND SWIVELING NECKTIE

FIELD OF THE INVENTION

The present invention relates to a convertible and swiveling necktie and method of use of the convertible and swiveling tie.

BACKGROUND OF THE INVENTION

Neckties are worn by many individuals, including business people and those attending events such as weddings or funerals. Other individuals wear neckties as part of a daily uniform, such as wait-staff at restaurants or clerks in retail establishments. Unfortunately, neckties often cause the user frustration, as the user struggles to tie the necktie in a satisfactorily-appearing and functioning knot. Even if a successful knot is tied, the tail section must also fall at an appropriate position on the user's torso, or the user must retie the necktie. For some individuals, appropriately tying the necktie may frustratingly consume several valuable minutes in the morning. Moreover, the parents of young children often struggle with attempting to get a necktie positioned on a young child.

Conventional neckties are also generally one-sided, meaning that they are not designed to be reversible. Also, conventional neckties do not provide for the knot portion to have a different design than the tail portion.

SUMMARY OF THE INVENTION

The present invention relates to a convertible and swiveling necktie and a method of using the convertible and swiveling necktie. The convertible and swiveling necktie includes a knot body, a tail body, wherein the tail body swivels relative to the knot body, and the tail body is urged to settle at increments of approximately 180 degrees. A fabric tail is affixed to the tail body. During use of the present invention, the user may insert or connect the tail body to the knot body. The user may also disconnect the tail body from the knot body and may connect a different tail body to the knot body. The knot body removably connects to a collar.

DETAILED DESCRIPTION OF PREFERRED EMBODIMENT

Figure 1:
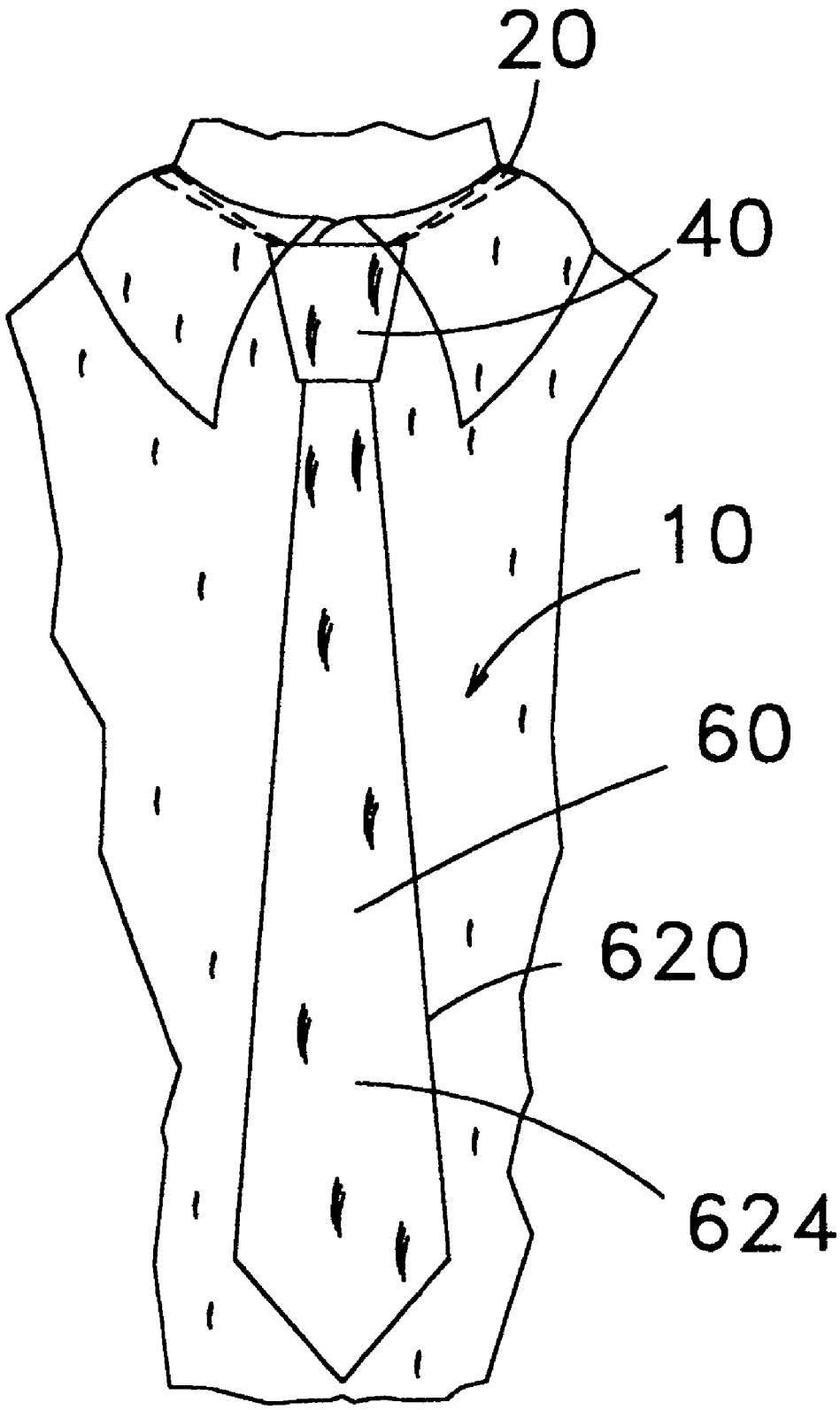
FIG. 1 is a view of the necktie of the present invention.

The present invention relates to a convertible and a swiveling necktie and a method of using the convertible and swiveling necktie. The convertible and swiveling necktie includes a knot body, a tail body, wherein the tail body swivels relative to the knot body, and the tail body is urged to settle at increments at approximately 180 degrees to maintain a desired side of a fabric tail. The present invention further includes the knot body forming an elliptically-shaped receiving portion, the tail body forming an elliptically-shaped member that is received by the elliptically-shaped receiving portion, and wherein the tail body is swively connected to the knot body.

The necktie of the present invention generally includes three main components, the collar, the knot and the tail. The knot appears to look like a conventional hand tied knot made in a conventional fabric tie; however, the knot of the present invention is a molded plastic structure with a fabric covering. A portion of the knot is hollow, as the knot receives the tail. The knot is secured to the collar. The collar includes a strip or length of a fabric material with fastening means to fit the collar around the user's neck. The collar is preferably adjustable to different-sized necks.

The knot generally includes a fabric knot cover. The fabric knot cover should coordinate with the appearance of the tail.

The tail generally includes a tail body. A fabric tail is attached to the tail body. The fabric tail has a similar appearance to a tail segment of a conventional hand-tied necktie. The tail body is rotatably connected to the knot body. The tail body (and consequentially the fabric tail) may be rotated to show a front and a backside of the fabric tail. The front side and the backside of the fabric tail may include different fabrics or different designs. The front side and the backside of the fabric tail may be joined with a French seam to conceal the stitching. Thus, the tail may be swiveled or rotated to show the different designs. In some embodiments, the same design may be used on both the front side and the backside to provide, for example, a waiter the ability to quickly and conveniently rotate their tie to hide a food spot or stain on the front side of the tie.

Importantly, the tail body of the present invention is frictionally held in approximately 180 degree increments by the connection between the knot and the tail. This provides for the tail body and fabric tail to generally face in a front or a back position. This also prevents the tail from accidentally rotating to a side that is not currently desired. The tail may be frictionally and rotatably connected to the knot such that a twisting force applied by the wearer is necessary for the tail body to swivel.

One embodiment of the present invention includes a double elliptical structure in which the knot body forms an elliptically-shaped receiving portion and the tail body forms an elliptically-shaped member that is received by the elliptically-shaped receiving portion. The elliptically-shaped receiving portion is larger than the elliptically-shaped member. The elliptically-shaped receiving portion and the elliptically-shaped member are nested, such that the elliptically-shaped member may rotate within the elliptically-shaped receiving portion. The longer sides of the ellipse are aligned parallel to the front and the back sides of the fabric tail. As the elliptically-shaped member rotates in the elliptically-shaped receiving portion, the elliptically-shaped receiving portion and/or the elliptically-shaped member must slightly deform or deflect to allow the elliptically-shaped member body to rotate. Thus, extra force is needed to overcome the interaction of the two elliptical structures. This provides for the tail to "rest" or be "urged" to rest at increments of approximately 180 degrees, and thus having the front or the back side of the fabric tail facing forward.

The fabric tail and the knot cover may be made from any conventional necktie materials, such as silk, polyester, rayon, cotton, wool, cotton-rayon blend, cotton-polyester blend, linen, cashmere, cashmere-linen blend, twill, woven silk, camel hair-linen blend, silk-linen blends, satin, cotton twill, and the like. The fabric tail may be approximately 17 inches to approximately 21 inches in length for a standard adult male sized version. The relative dimensions of the fabric tail may be adjusted accordingly by one of ordinary skill in the art for women and children versions of the present invention.

The knot body and the tail body are made from any dry clean chemical-resistant plastic material, such as acrylic, polyacrylic, polyethelyne, polyvinyl chloride (PVC), polypropylene, polycarbonate, acrylonitrile butadiene styrene (ABS), hard rubber, silicone, high density polyethylene, nylon, phenolic resin, high density polyurethane, styrene acrylonitrile, polyester, saturated thermoplastic polyester, and epoxy compounds. The plastic material should provide a hard and smooth surface to promote ease of sliding between the elliptically-shaped receiving portion and elliptically-shaped member. The plastic material should further withstand the deformation or deflection resulting from the rotation of the elliptically-shaped member without cracking. The knot body and the tail body may be formed from injection molding, thermal molding, and other conventional plastic forming techniques.

The collar may be made from many of the same materials as the fabric tail. The material for the collar should coordinate with the materials for the fabric tail. For a standard adult male sized version off the present invention, the collar is about ⅝ inches in width and the collar is approximately 18 inches to approximately 24 inches in length. This length provides an approximately six inch "window" for adjustment to fit different sized necks of the users. Loop fasteners, buttons, snaps and other conventional fabric fastening means may be used to connect the ends of the collar. For convenience and comfort purposes, hook and loop fasteners are preferred. The relative dimensions of the collar may be adjusted accordingly by one of ordinary skill in the art for women and children versions of the present invention.

Figure 2:
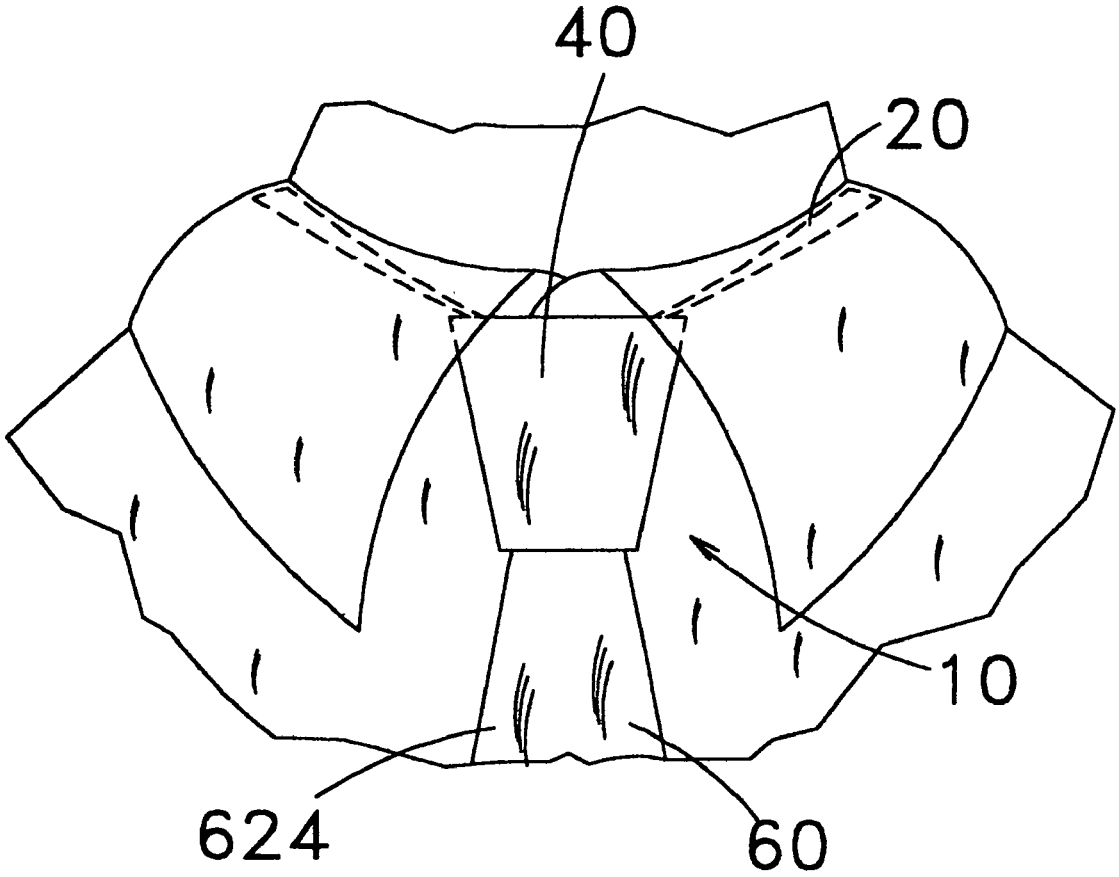
FIG. 2 is a close-up view of the necktie of the present invention.
Figure 3A:
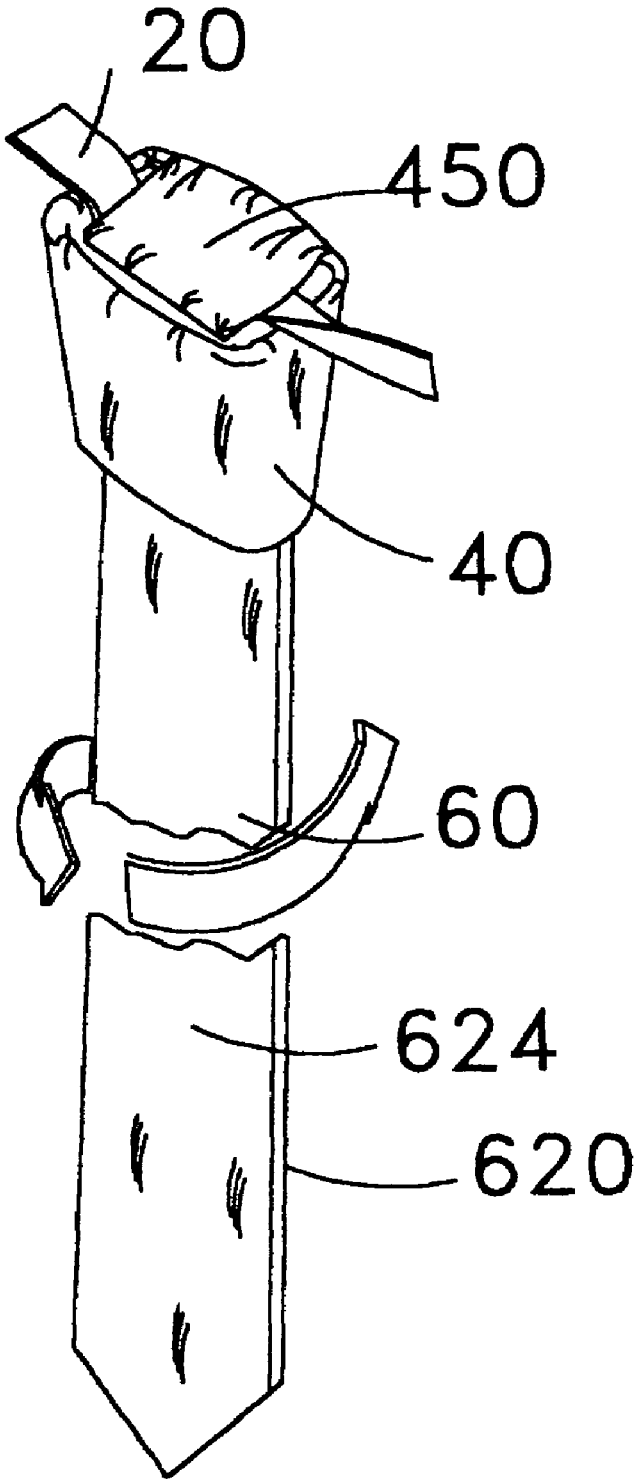
FIGS. 3(*a*)-3(*c*) are views showing the swiveling of the tail body and the fabric tail.
Figure 3B:
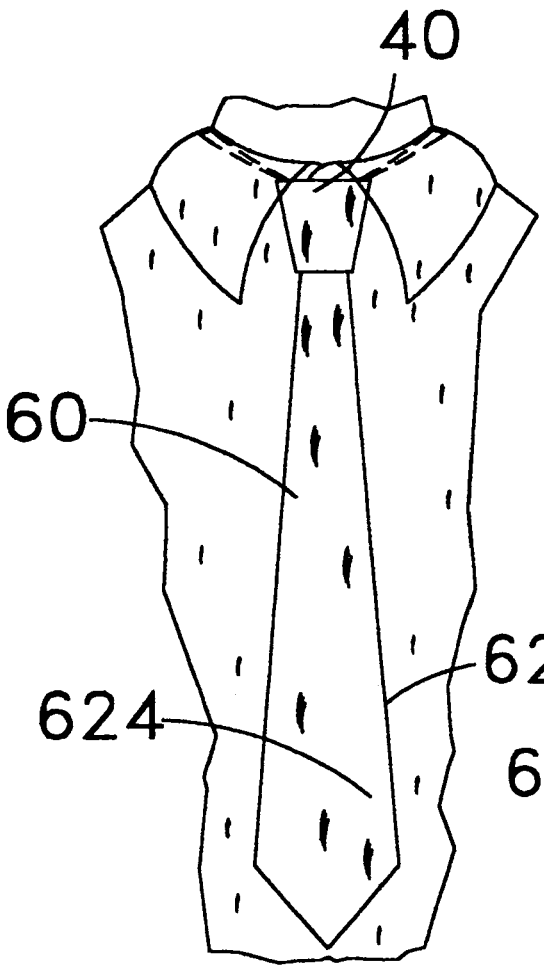
Figure 3C:
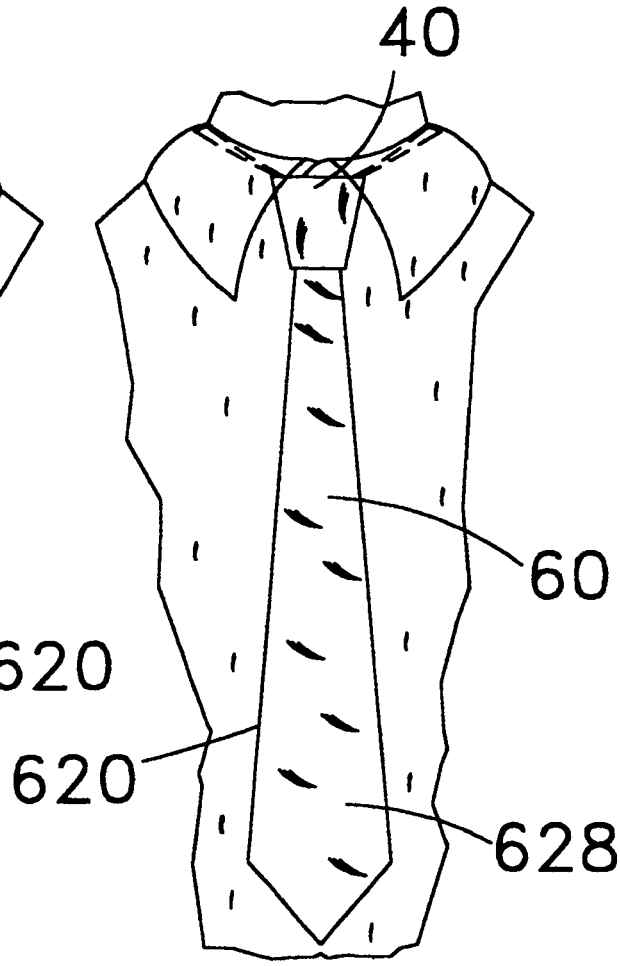

The present invention will now be described with reference to a preferred embodiment shown in the figures:

With reference to FIGS. 1 and 2, a necktie 10 is shown including a collar 20, a knot 40, and a tail 60. The knot 40 is removably attached or connected to the collar 20. As shown in FIGS. 3(*a*)-3(*c*), the tail 60 is swively connected to the knot 40. The tail 60 includes a fabric tail 620 that further includes a first side 624 and a second side 628. The fabric tail 620 is formed over a tail cover 630 (shown in FIG. 8). The tail cover 630 is an elliptically-shaped member having an opening 631. The fabric tail 620 may be glued to the tail cover 630.

Figure 4A:
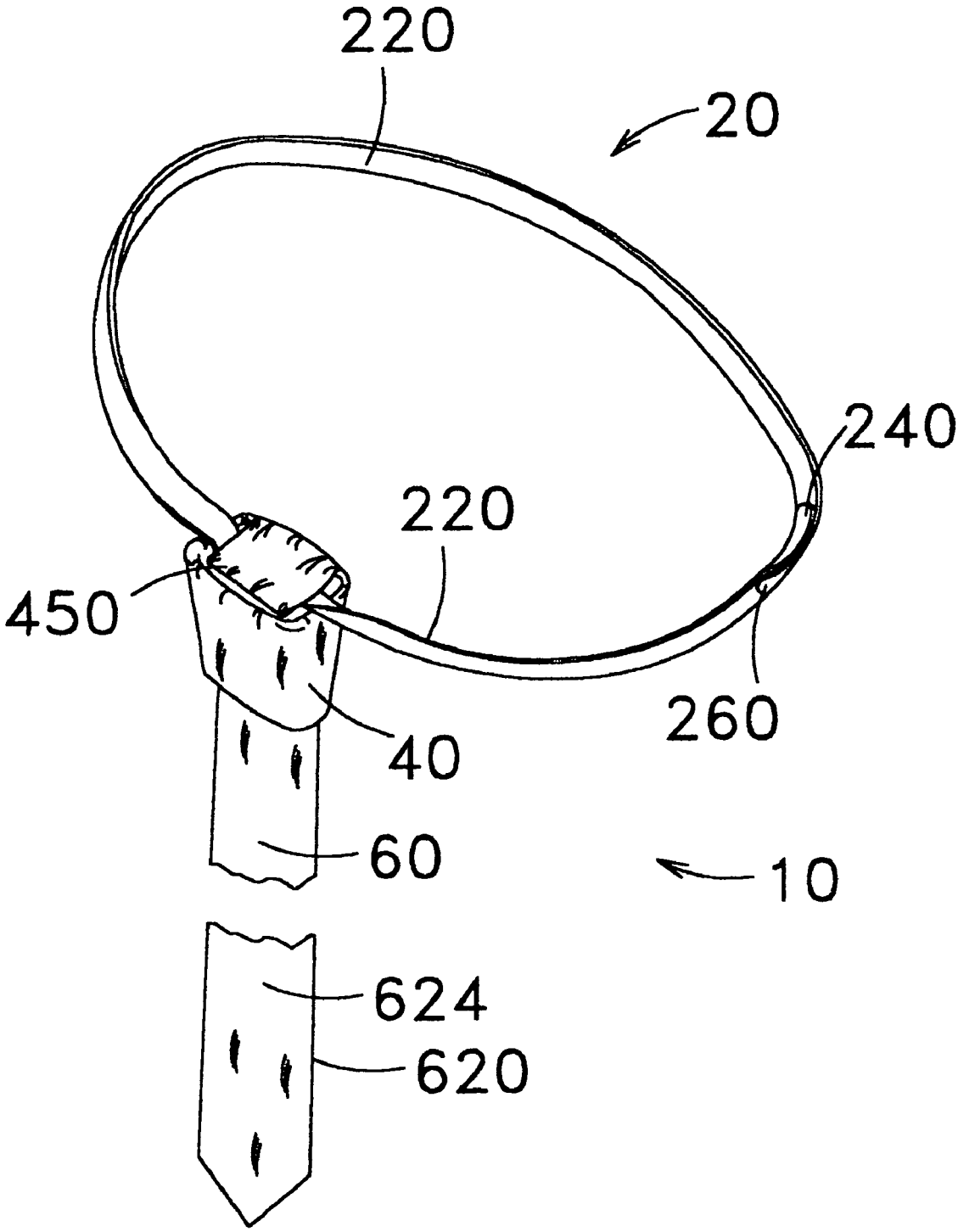
FIGS. 4(*a*) and 4(*b*) are views of the collar and the tab.
Figure 4B:
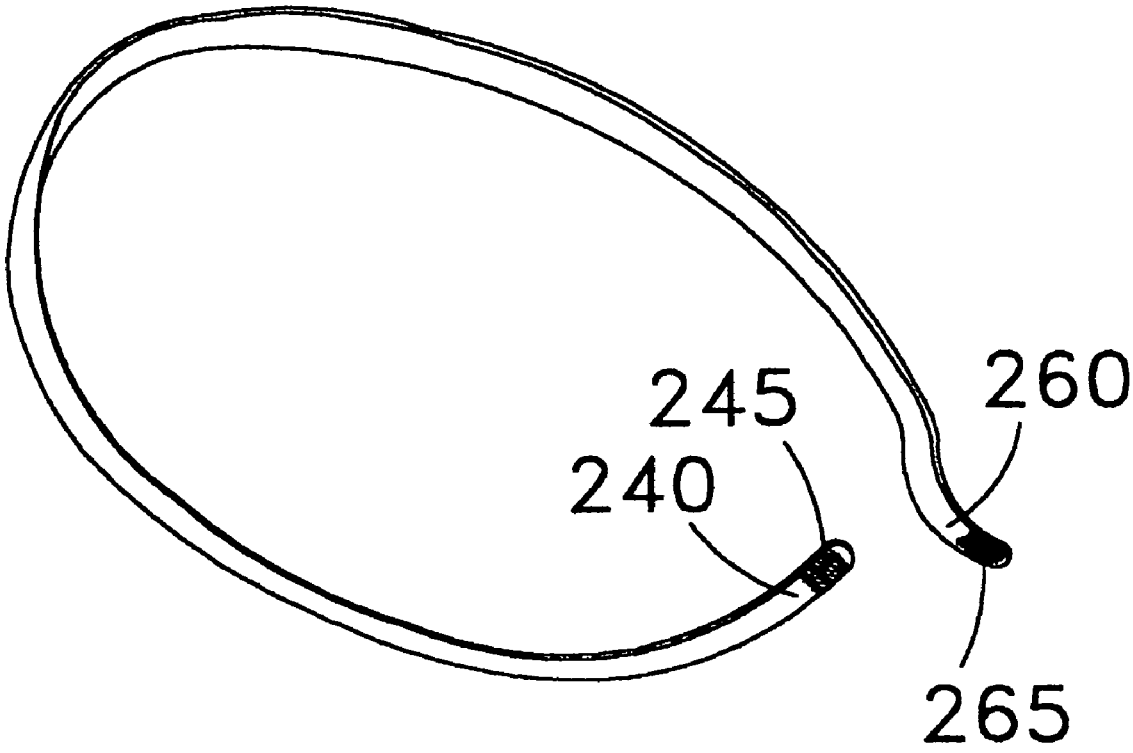

With reference to FIGS. 4(*a*) and 4(*b*), the collar 20 will now be described in detail. The collar 20 includes a strip or length of a material 220 having a first end 240 and a second end 260. The first end 240 includes hook fasteners 245, and the second end 260 includes loop fasteners 265. In use of the collar 20, the first end 240 may be connected to the second end 260 via the hook fasteners 245 and the loop fasteners 265 to fasten the collar. In other embodiments of the present invention, the collar 20 may include other conventional fastening means such as buttons, snaps, etc. commonly used in the garment industry.

Figure 5:
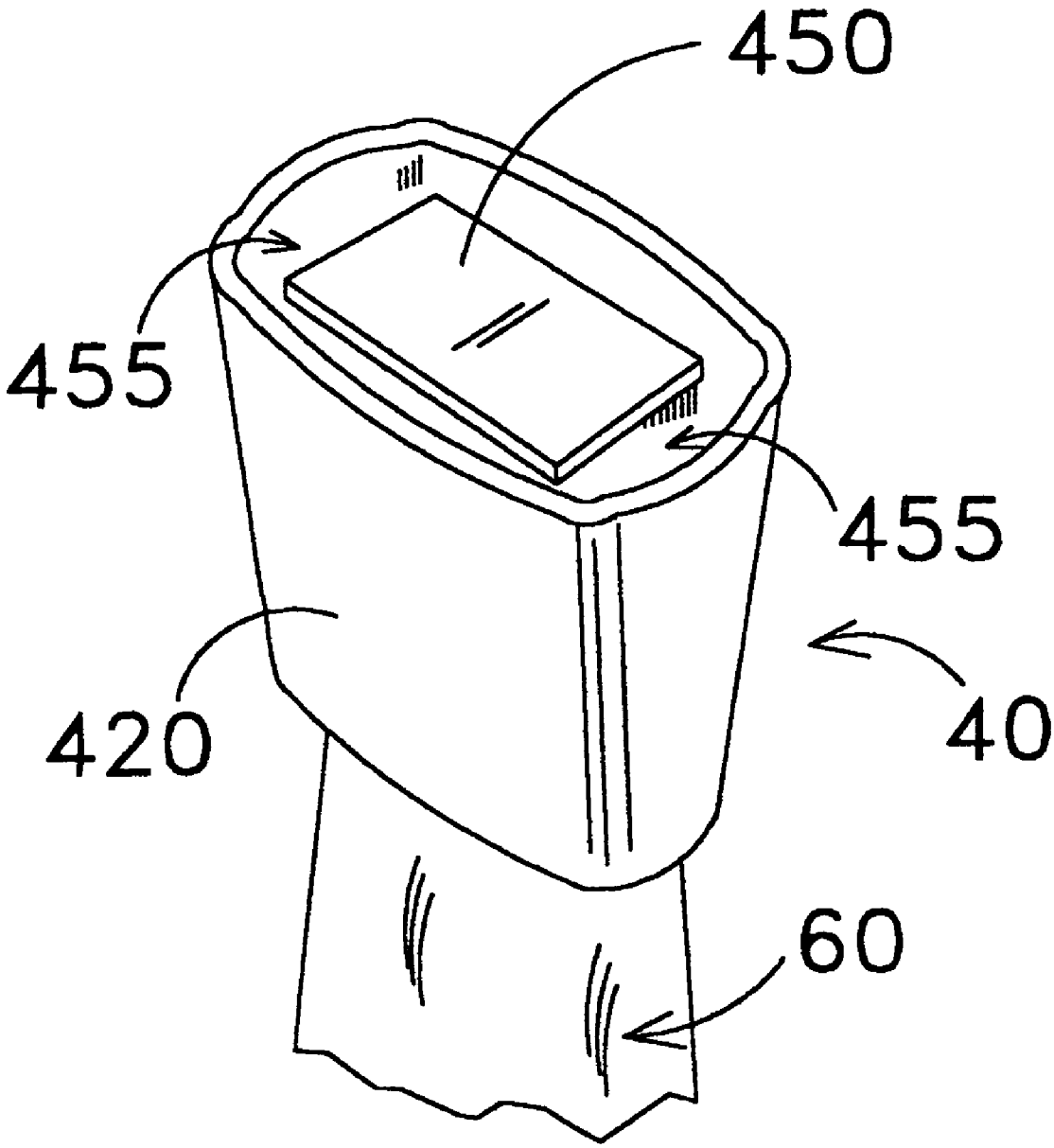
FIG. 5 is a view of the knot body.
Figure 6:
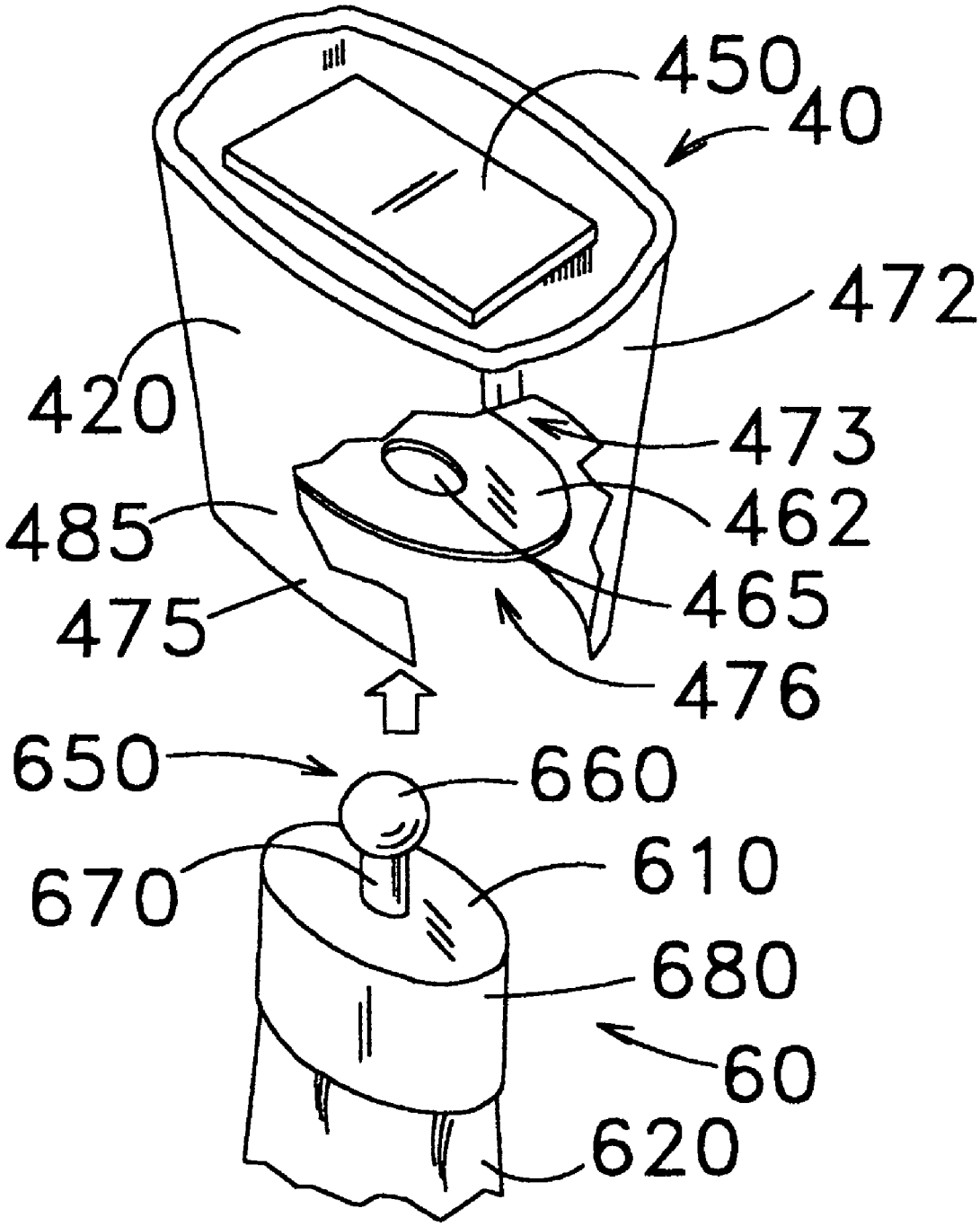
FIG. 6 is a view showing the connection of the tail body and the knot body.
Figure 7:
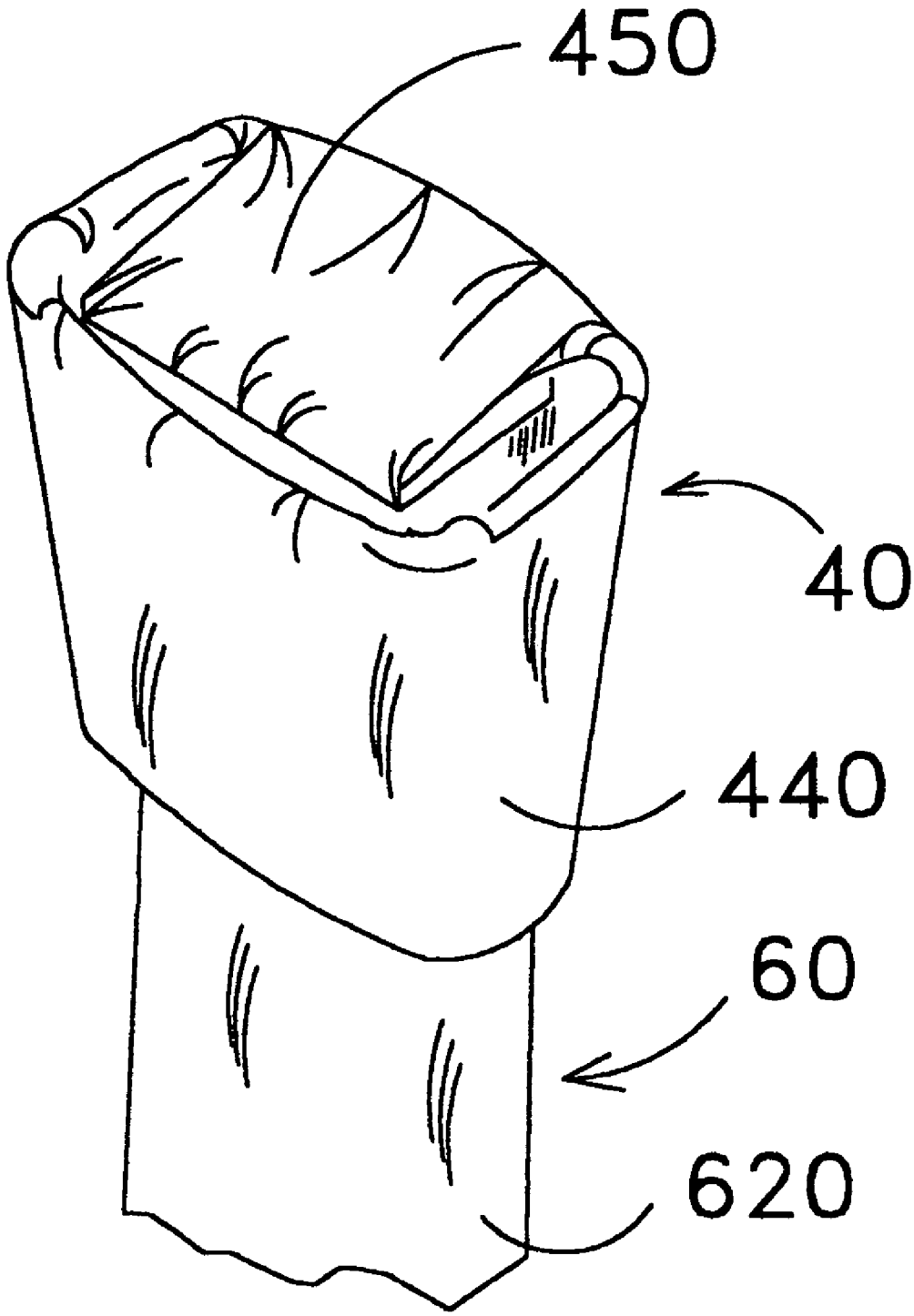
FIG. 7 is a view of the knot body with its fabric cover.

With reference to FIGS. 5, 6, and 7, the knot 40 will now be described. A knot body 420 is shown as the central portion of the knot 40. A knot cover 440 (shown in FIG. 7) provides a decorative covering to the knot body 420. The knot tab 450 is shown as a bent portion that forms a channel 455 (shown in FIG. 5) for threading and receiving the collar 20.

The knot body 420 includes a partition 462 that separates the knot body 420 into an upper knot body 472 and a lower knot body 475. The upper knot body 472 defines a hollow upper region 473. The lower knot body 475 defines a hollow lower region 476. The partition 462 includes an aperture 465. The knot body 420, by its lower knot body 475, also forms a knot body ellipse 485 that circumscribes the hollow lower region 476.

Figure 8:
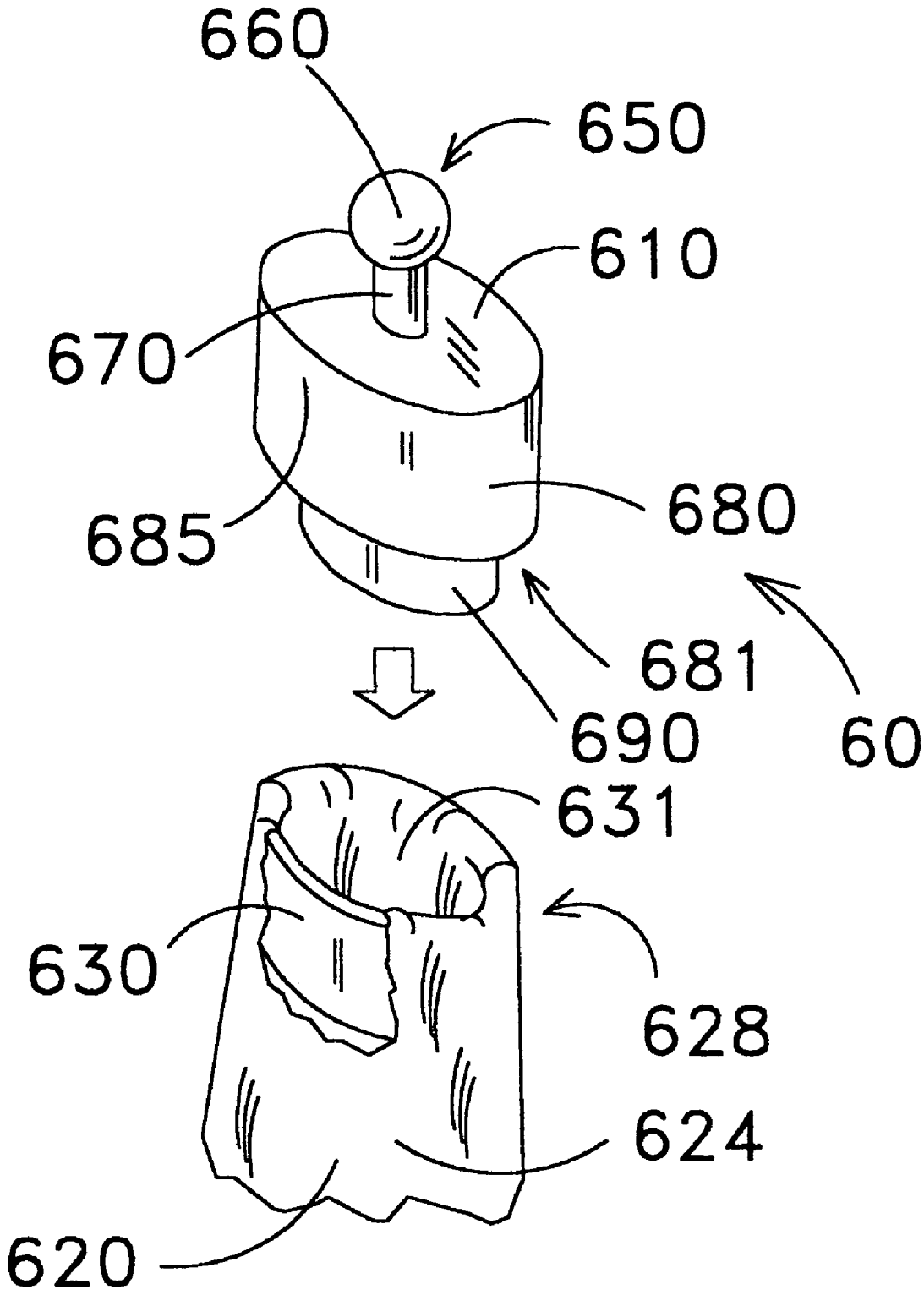
FIG. 8 is a view showing the connection of the fabric tail to the tail body.

With reference to FIG. 8, the tail 60 will now be described. The tail 60 includes a tail body 610 which connects to the knot body 420. The fabric tail 620 connects to the tail body 610.

Figure 9:
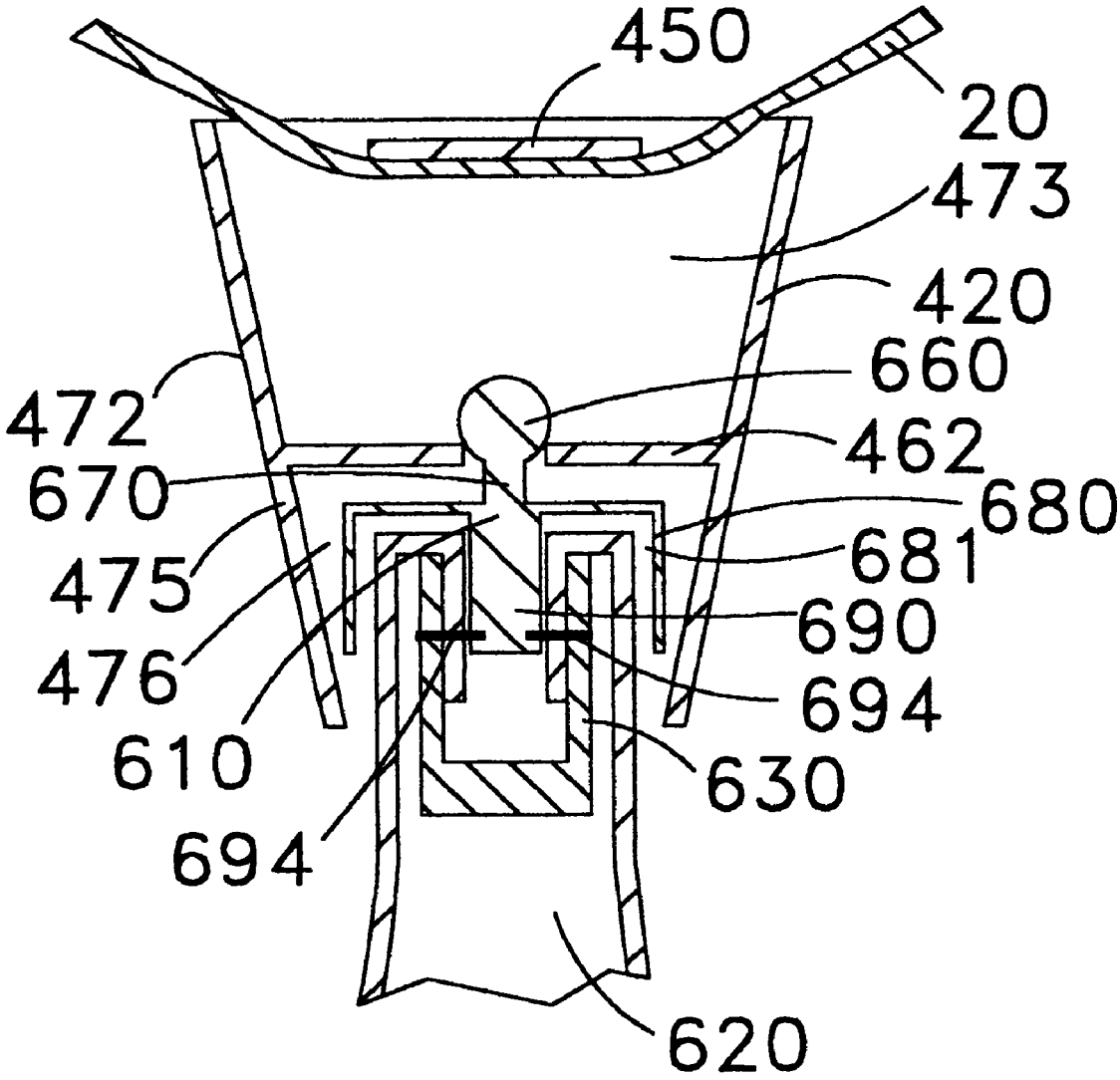
FIG. 9 is a sectional view showing the connection of the knot body to the tail body.
Figure 10:
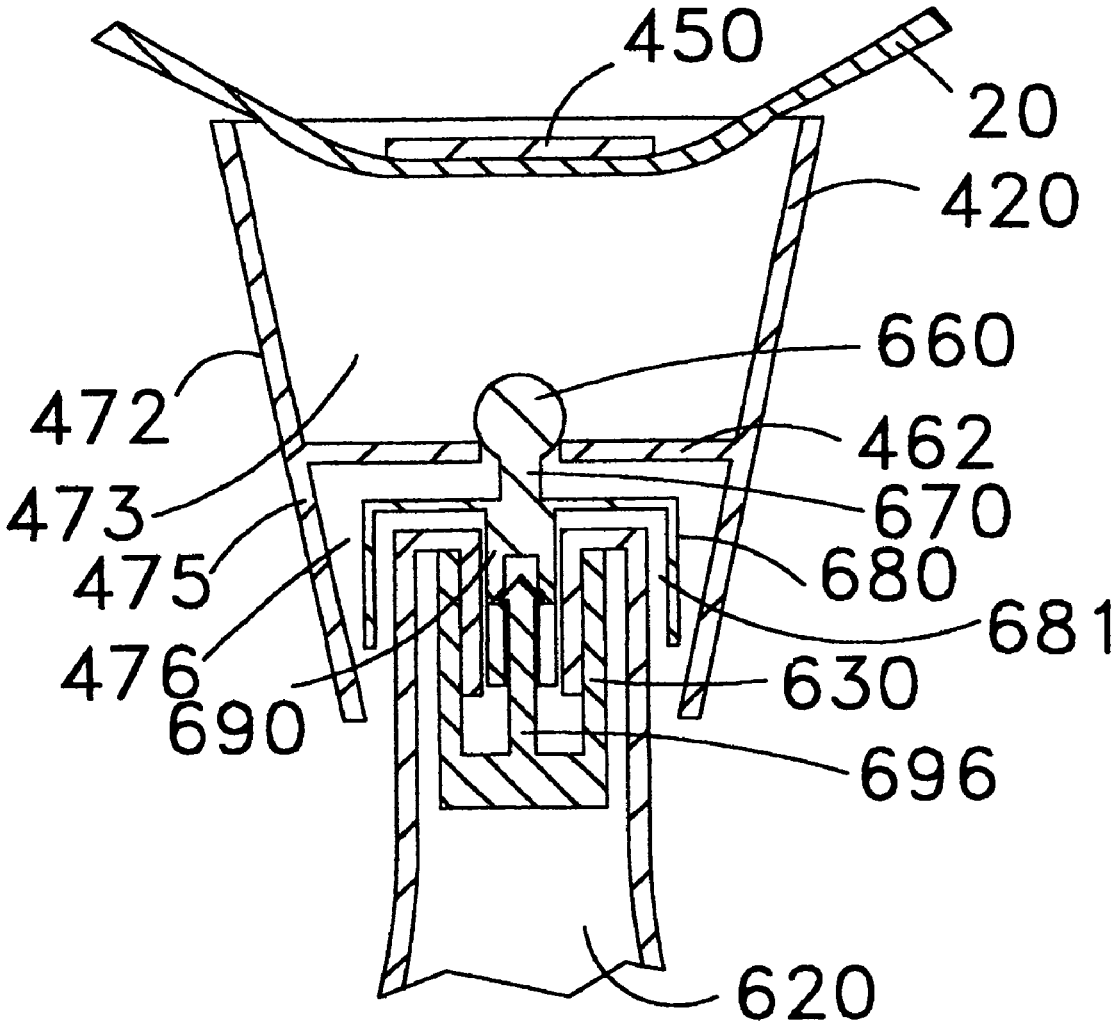
FIG. 10 is a sectional view of an alternate embodiment showing the connection of the knot body and the tail body.

The tail body 610 includes a male connection 650, which further includes a bulbous portion 660 and a narrow portion 670. As shown in FIG. 9, the bulbous portion 660 is pushed through the aperture 465 in the partition 462 of the knot body 420. The narrow portion 670 connects to a flange 680, which forms a tail ellipse 685. The tail ellipse 685 provides a surface that will contact the knot body ellipse 485. The flange 680 includes a hollow region 681 defined by the tail ellipse 685 to secure the tail cover 630. Below the flange 680, the tail body 610 forms an insert portion 690 that is inserted into the opening 631 of the tail cover 630. The insert portion 690 should be complimentary in shape to the opening 631 of the tail cover 630. The insertion of the insert portion 690 into the tail cover 630 assists in securing the fabric tail 620 to the tail body 610. In this embodiment, a pin 694 (shown in FIG. 9) secures the tail cover 630 to the tail body 610. In another embodiment shown in FIG. 10, a plastic fitting 696 connects the tail cover 630 to the tail body 610.

When the bulbous portion 660 of the tail body 610 is inserted into the aperture 465 of the partition 462, a force necessary to "pop" the bulbous portion 660 through the aperture 465 is required. Once the bulbous portion 660 has popped through the aperture 465, and into the hollow upper region 473 the tail body 610 and the tail cover 630 are swively connected to the knot body 420. The bulbous portion 660 rotates above the partition 462 in the hollow upper region 473, while the narrow portion 670 passes through the aperture 465 into the hollow lower region 476 and connects the bulbous portion 660 to the flange 680.

The tail body 610 may be removed from the knot body 420 by pulling on the tail body 610 until the bulbous portion 660 is pulled through the aperture 465. Thus, the body 610 may be removed and replaced with a different tail body 610 with a different fabric tail 620.

When the tail body 610 is connected to the knot body 420, the flange 680 forming the tail ellipse 685 is contained in the hollow lower region 476. The lower knot body 475 conceals the flange 680 and helps to provide the appearance of a conventional hand-tied tie.

Figure 11A:
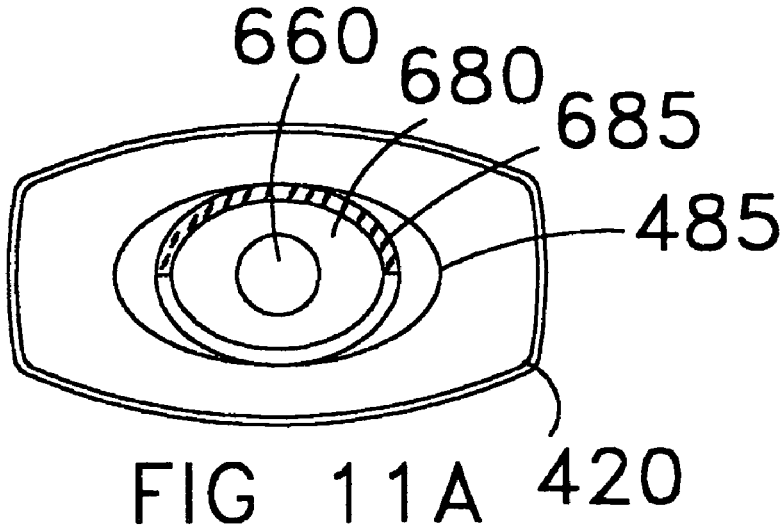
FIGS. 11(*a*)-11(*c*) are views of the tail body rotating relative to the knot body.
Figure 11B:
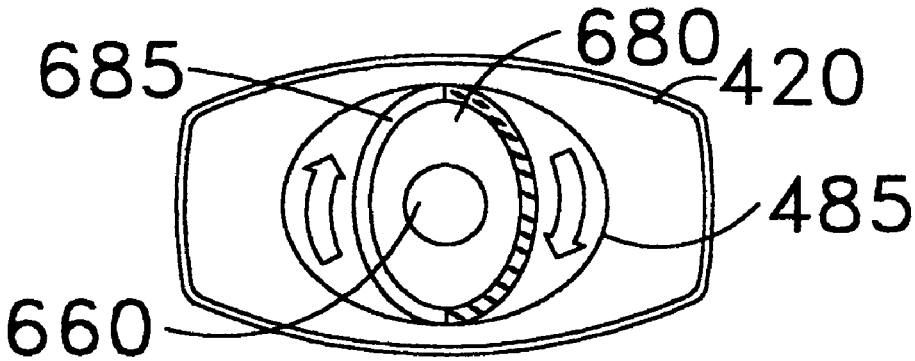
Figure 11C:
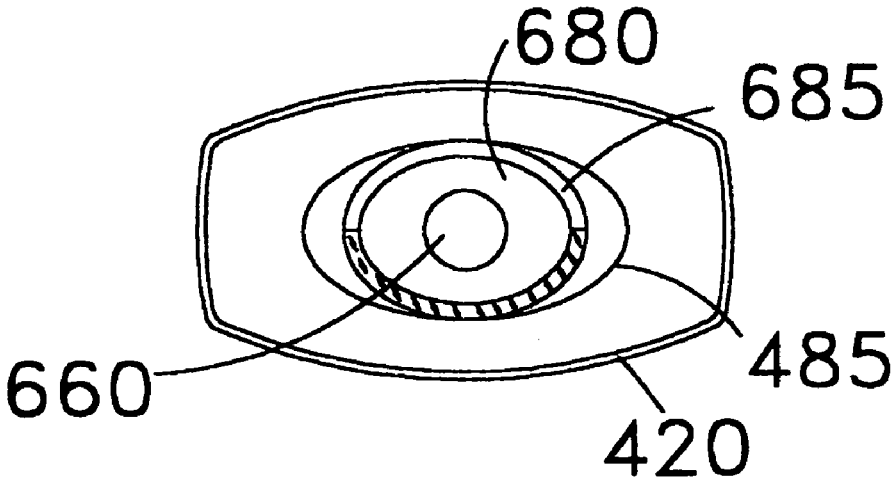

As shown in FIGS. 11(*a*)-11(*c*), during the rotation of the tail body 610, a perimeter of the tail ellipse 685 presses against the knot body ellipse 485 and the tail body 610 must be given a twisting force in order for the tail body 610 to rotate. The twisting force should be sufficient to cause the tail ellipse 685 and/or knot body ellipse 485 to slightly and temporarily deform or deflect to allow the rotation of the tail body 610. This structural relationship between the tail ellipse 685 and the knot body ellipse 485 tends to settle the tail body 610 at 180 degree intervals, and thus urging the front side 624 or back side 628 of the fabric tail 620 to face forward. This interaction is shown in FIGS. 11(*a*)-11(*c*). Preferably, the tail ellipse 685 and/or knot body ellipse 485 are made from a material that provides for the deformation, deflection, and the resiliency.

Figure 12:
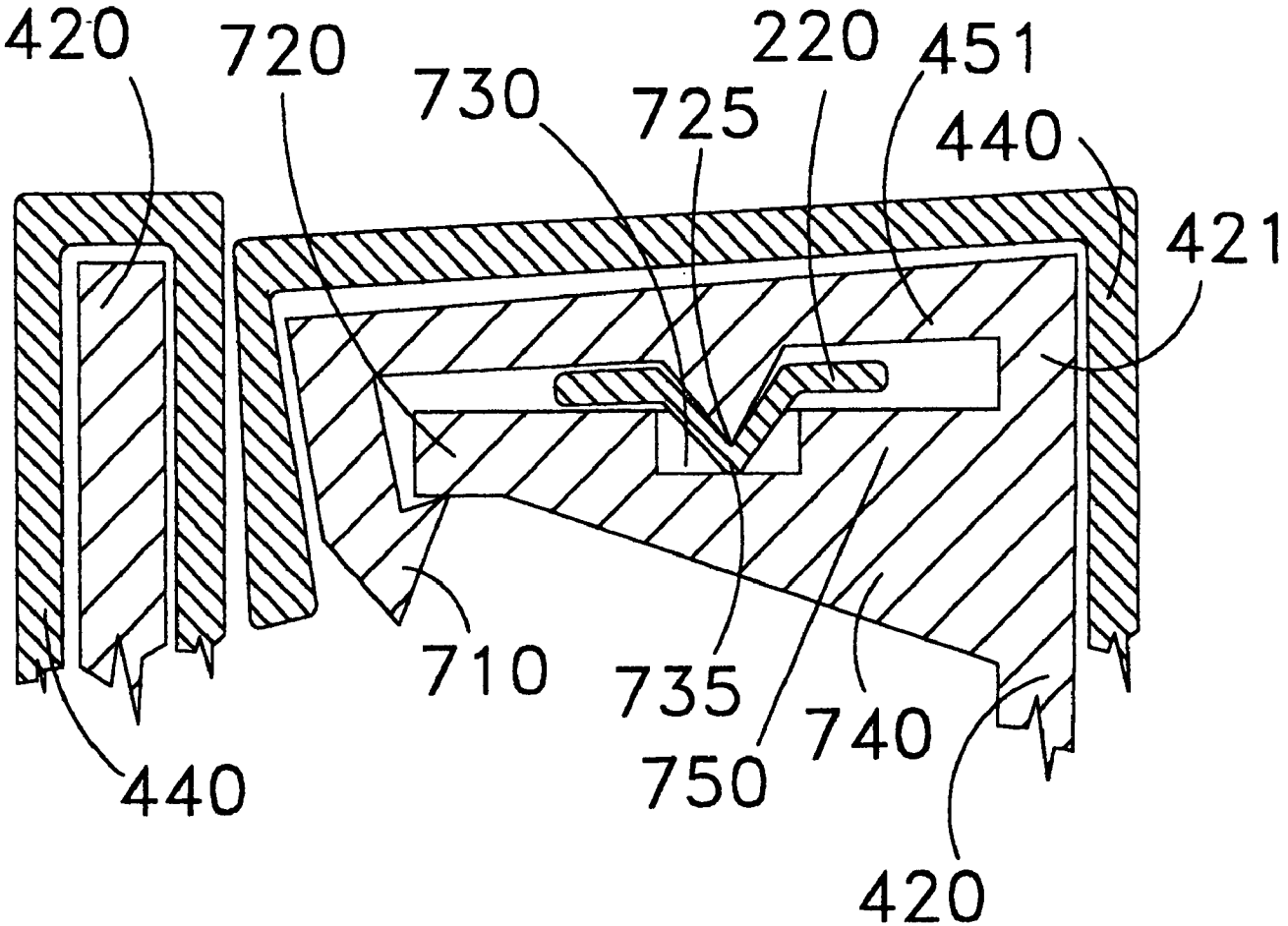
FIG. 12 is a view of an alternative knot tab.

With reference to FIG. 12, an alternative knot tab 451 is shown. The alternative knot tab 451 provides a crimping or securing feature to assist in maintaining the positioning of the knot body 420 on the collar material 220. The alternative knot tab 451 reduces the likelihood that the knot body 420 will get displaced or move laterally on the collar material 220.

The alternative knot tab 451 includes a closure member 710 that fictionally clips about a lateral member 720. A region 750 of the lateral member 720 connects or is integral with a wall 421 of the knot body 420. The lateral member 720 is shown supported by a gusset 740.

The closure member 710 includes a point 725. When the closure member 710 is crimped or secured to the lateral number 720, the point 725 presses firmly against the collar material 220. The point 725 presses the collar material 220 into or against a depression or a hole, 730, which frictionally secures a portion 735 of the collar material 220.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

What is claimed is:

1. A convertible and swiveling necktie, comprising:

a knot body having a non-circular, elliptically-shaped opening;

a tail body having a non-circular, elliptically-shaped member, wherein the non-circular, elliptically-shaped opening receives the non-circular, elliptically-shaped member to form the necktie;

wherein the tail body swivels relative to the knot body causing the non-circular, elliptically-shaped opening or the non-circular, elliptically-shaped member to deform or deflect during the swiveling, and the tail body is urged to settle at increments of approximately 180 degrees.

2. The convertible and swiveling necktie according to claim 1, wherein the tail body further comprises a fabric tail affixed or connected to the tail body.

3. The convertible and swiveling necktie according to claim 2, wherein the fabric tail is reversible to show a first side of the fabric tail and to show a second side of the fabric tail.

4. The convertible and swiveling necktie according to claim 2, wherein the tail body further comprises a fabric tail affixed or connected to the tail body, and the tail body may be replaced with a second tail body.

5. The convertible and swiveling necktie according to claim 1, wherein the knot body further comprises a knot cover.

6. The convertible and swiveling necktie according to claim 1, wherein the tail body includes a male connection having a bulbous portion and a narrow portion.

7. The convertible and swiveling necktie according to claim 6, wherein the bulbous portion is pushed through an aperture of the knot body.

8. The convertible and swiveling necktie according to claim 1, wherein the knot body forms a hollow portion to receive the non-circular, elliptically-shaped member.

9. The convertible and swiveling necktie according to claim 1, wherein the non-circular, elliptically-shaped member is inserted into the non-circular, elliptically-shaped opening.

10. A convertible and swiveling necktie, comprising:

a knot body forming a non-circular, elliptically-shaped receiving portion comprising a hollow portion defined by the non-circular, elliptically-shaped receiving portion;

a tail body forming a non-circular, elliptically-shaped member that is received into the hollow portion of the non-circular, elliptically-shaped receiving portion to form the necktie; and wherein the tail body is swivelly connected to the knot body and, the non-circular, elliptically-shaped member rotates within the hollow portion body causing the non-circular, elliptically-shaped receiving portion or the non-circular, elliptically-shaped member to deform or deflect during the swiveling.

11. The convertible and swiveling necktie according to claim 10, wherein the non-circular, elliptically-shaped receiving portion and the non-circular, elliptically-shaped member are nested, such that the non-circular, elliptically-shaped member may rotate within the non-circular, elliptically-shaped receiving portion.

12. The convertible and swiveling necktie according to claim 10, further comprising a collar, wherein the knot body is attached or connected to the collar.

13. The convertible and swiveling necktie according to claim 10, wherein the non-circular, elliptically-shaped receiving portion and the non-circular, elliptically- shaped member are nested, such that the non-circular, elliptically-shaped member may rotate within the non-circular, elliptically-shaped receiving portion after sufficient force is applied.

14. The convertible and swiveling necktie according to claim 13, wherein the non-circular, elliptically-shaped member rotates in the non-circular, elliptically-shaped receiving portion, and wherein one or both of the non-circular, elliptically-shaped receiving portion and the non-circular, elliptically-shaped member slightly deform or deflect to allow the elliptically-shaped member body to rotate.

15. The convertible and swiveling necktie according to claim 10, wherein the knot body includes a tab that crimps against or secures to a collar.

16. A method of using a convertible and swiveling necktie, comprising:

providing a knot body having a non-circular, elliptically-shaped receiving member;

providing a tail body having a non-circular, elliptically-shaped member;

inserting the non-circular, elliptically-shaped member of the tail body into the non-circular elliptically-shaped portion of the knot body, wherein the tail body swivels relative to the knot body, and the tail body is urged to settle at increments of approximately 180 degrees.

17. The method according to claim 16, wherein the knot body forms the non-circular, elliptically-shaped receiving member having a hollow portion.

18. The method according to claim 17, wherein the non-circular elliptically-shaped member rotates within the non-circular, elliptically-shaped receiving member.

19. The method according to claim 17, further comprising:

applying a twisting force to overcome an interaction of the tail body and the knot body.

20. A convertible and swiveling necktie, comprising:

a knot body having a non-circular, elliptically-shaped receiving portion;

a tail body having a non-circular, elliptically-shaped member, wherein the non-circular, elliptically-shaped receiving portion receives the non-circular, elliptically-shaped member to form the necktie;

wherein the tail body includes a male connection having a bulbous portion and a narrow portion, wherein the bulbous portion is pushed through an aperture of the knot body, wherein the tail body swivels relative to the knot body and the tail body is urged to settle in increments of approximately 180 degrees with longer sides of the non-circular, elliptically-shaped receiving portion in parallel with longer sides of the non-circular, elliptically-shaped member.

* * * * *